United States Patent [19]

Cheney

[11] 4,162,144

[45] Jul. 24, 1979

[54] METHOD AND APPARATUS FOR TREATING ELECTRICALLY CHARGED AIRBORNE PARTICLES

[75] Inventor: William A. Cheney, Cincinnati, Ohio

[73] Assignee: United Air Specialists, Inc., Cincinnati, Ohio

[21] Appl. No.: 799,464

[22] Filed: May 23, 1977

[51] Int. Cl.[2] ..... B03C 1/00

[52] U.S. Cl. ..... 55/5; 55/107; 55/138; 361/229

[58] Field of Search ..... 55/2, 5, 107, 101, 128, 55/133, 138, 136, 137; 361/229

[56] References Cited

U.S. PATENT DOCUMENTS

| | | | |
|---|---|---|---|
| 1,343,285 | 6/1920 | Schmidt | 55/2 |
| 2,665,770 | 1/1954 | Richardson | 55/138 |
| 3,091,069 | 5/1963 | Brasefield | 55/5 |
| 3,626,669 | 12/1971 | Cordiff | 55/128 |
| 3,826,063 | 7/1974 | Festner | 55/128 |
| 3,862,826 | 1/1975 | Haupt | 55/138 |

FOREIGN PATENT DOCUMENTS

| | | | |
|---|---|---|---|
| 1973340 | of 1913 | United Kingdom | 55/138 |

OTHER PUBLICATIONS

Electrically Charged Dust Rooms—Penney et al., pp. 1-5, dated 2/4/49, AIEE, pp. 49-74.

*Primary Examiner*—Bernard Nozick

*Attorney, Agent, or Firm*—Melville, Strasser, Foster & Hoffman

[57] ABSTRACT

A method and apparatus for treating electrically charged airborne particles to reduce deposition of the particles on walls and other exposed surfaces in an enclosed area. Air containing positively charged particles exhausted from a first group of electrostatic precipitators is admixed with air containing negatively charged particles exhausted from a second group of electrostatic precipitators, the mixed air containing oppositely charged particles having less tendency to become deposited on walls and other surfaces in the enclosed area.

10 Claims, 7 Drawing Figures

METHOD AND APPARATUS FOR TREATING ELECTRICALLY CHARGED AIRBORNE PARTICLES

BACKGROUND OF THE INVENTION

1. Field of the Invention

The apparatus and method of the present invention relate genrally to removing airborne particles by electrostatic precipitation, and more particularly to treating electrically charged airborne particles to reduce deposition of the particles on walls and other exposed surfaces in an enclosed area.

2. Description of the Prior Art

The removal of solid or liquid airborne particulate contaminants by electrostatic precipitator air cleaning systems is quite well known and widely practiced in commercial and industrial environments. It has been shown that such systems can capture up to 99% of all airborne particulates from 0.01 micrometer to about 100 micrometers in diameter. Included within this range are respirable fraction particles that are most damaging to the human lungs, since they tend to bypass the bodys natural filters and defense mechanisms.

The operation of such electrostatic precipitator air cleaners, such as the popular two-stage Penney type, is well known in the art and only need briefly be described. Such a precipitator operates on the principle of charging contaminants electrostatically and then collecting the charged particles on a ground plate in an electrostatic field. Contaminated air drawn into the precipitator, by a fan or blower, may be screened by a mechanical prefilter which removes large airborne particles from the airstream. The air then passes through an ionizer where it is subjected to an intense electrostatic field, which electrically charges all the airborne particles in the airstream. These charged particles next enter the collecting cell where collecting plates of the same polarity as the charged particles repel the charged particles toward plates of ground potential which strip the particles from the airstream. An afterfilter may be included to improve the collection efficiency by trapping any agglomerated contaminants.

It has been a long standing problem that such precipitator air cleaners tend to exhaust an undesirable quantity of electrically charged particles under certain conditions. This problem has been found to be particularly acute in working environments having very contaminated air, such as might be found in manufacturing facilities performing welding and other smoke-producing operations. Moreover, the problem may be aggravated during conditons of low relative humidity. These free electrically charged airborne particles exhausted by the electrostatic precipitator air cleaners tend to be deposited on exposed surfaces, such as walls and shelves, as well as equipment in the working environment, forming a dirty film thereon. It has also been suggested that this precipitated dirt may interfere with the operation of mechanical equipment, resulting in increased wear and equipment failure. Hence a solution has been sought to prevent this particulate build-up on such surfaces.

It has been proposed to add additional mechanical filter stages to the outlet of the electrostatic precipitator air cleaner to trap these charged airborne particles. However, such filters have not proved totally effective, becoming easily clogged and disrupting the precipitator's clean air distribution.

SUMMARY OF THE INVENTION

The present invention provides a solution to this long felt problem by treating the electrically charged airborne particles exhausted from the electrostatic precipitator air cleaners, thereby reducing deposition of the particles on walls and other exposed surfaces in the working area.

In the present invention a first group of one or more electrostatic precipitators exhausts air containing positively charged particles into the working area. A second group of one or more similar electrostatic precipitator air cleaners of reversed polarity exhaust air containing negatively charged particles into the working area. The airstreams from both groups of air cleaners are mixed, either in a mixing chamber or in the room itself, to greatly reduce the tendency of the particles to become deposited on walls and other exposed surfaces, thereby contributing to the overall cleanliness of the working area and the efficiency of the electrostatic precipitator air cleaners.

As will be described in more detail hereinafter, the exhaust air from the oppositely polarized air cleaners may be admixed in several different ways. In one embodiment, a single operating air cleaner enclosure produces exhaust air containing oppositely charged particles in parallel airstreams, and blends the airstreams in a mixing chamber with a common blower. In another embodiment, a plurality of individual oppositely polarized electrostatic precipitator air cleaners are distributed throughout the working area such that their exhaust airstreams are brought into contact with each other to obtain mixing of the airstreams.

DESCRIPTION OF THE PREFERRED EMBODIMENTS

In general, the present invention utilizes a first group of electrostatic precipitator air cleaners exhausting air containing positively charged particles and a second group of electrostatic precipitator air cleaners exhausting air containing negatively charged particles. The charged particles from each group of air cleaners are admixed to reduce the tendency of the particles to become deposited on walls and other surfaces in the enclosed area. Each group of air cleaners may consist of one or more electrostatic precipitator air cleaners mounted in various physical arrangements.

As is well known in the art, conventional electrostatic precipitator air cleaners, such as the SMOG-HOG® and SMOKEETER® models manufactured by United Air Specialists, Inc. of Cincinnati, Ohio, used in industrial and commercial air cleaning applications, respectively, utilize a common high voltage power supply to produce the voltages necessary for the ionizer and collecting cells. For example, a typical power supply may produce a large positive voltage for the air cleaner ionizer and a large positive voltage on plates interleaved with ground potential plates for the collecting cell. Such an air cleaner arrangement could exhaust, under certain circumstances, a surplus of positive electrically charged particles, which would tend to collect on walls and other surfaces as described hereinbefore. It has been found, however, that the relative potential differences of the ionizer and collecting cells may be reversed such that the air cleaner exhausts, under certain circumstances, a surplus of negative electrically charged particles which can be mixed with the positive particles exhausted by electrostatic precipitators having positive power supplies to reduce the tendency of the particles to become deposited on walls and other surfaces in the enclosed area. Such a modification to the air cleaner is brought about by merely reversing the polarity of the high voltage supply, thereby impressing a negative voltage on the ionizer and the collecting cell. As is well understood in the art, such modifications to the high voltage power supply are easily made.

Figure 1:
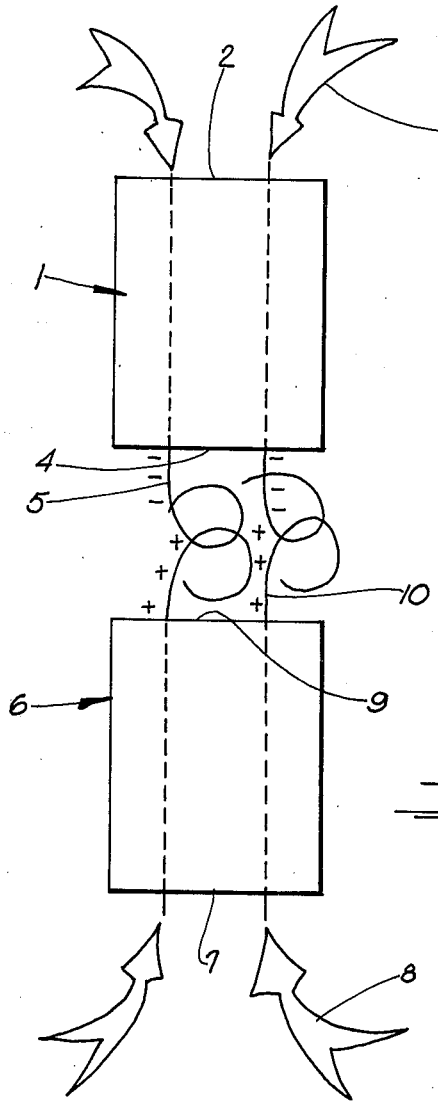
FIG. 1 is a schematic plan view of a pair of individually mounted oppositely polarized electrostatic precipitator air cleaners arranged to mix their respective airstreams.

The use of such oppositely polarized electrostatic precipitator air cleaners in the present invention is illustrated in one embodiment in FIG. 1. A first air cleaner is shown generally at 1, having means 2, such as a mechanicl prefilter, for admitting contaminated air 3 into the air cleaner, and means 4, such as a blower and mechanical after filter (not shown) for exhausting relatively clean air 5 containing negatively charged particles into a suitable working area (not shown). It will be understood that air cleaner 1 may comprise a plurality of such air cleaners exhausting negative particles, and may be mounted within the working area in any conventional manner, such as suspended from a ceiling, etc.

A second electrostatic precipitator, shown generally at 6, of opposite polarity to air cleaner 1, has similar means 7 for admitting contaminated air 8, and means 9 for exhausting relatively clean air 10 containing positively charged particles into the working area. It will be further understood by one skilled in the art, that electrostatic precipitator 6 may comprise a plurality of such positively charged particle exhausting air cleaners.

Air cleaners 1 and 6 are arranged as shown in FIG. 1, so that the exhaust airstreams bearing oppositely charged particles may thoroughly admix in the working area to reduce the tendency of the oppositely charged airborne particles to be deposited on walls and other surfaces, contributing to overall cleanliness. The airborne particles remaining may be further stripped from the air by additional air cleaners, not shown.

Figure 7:
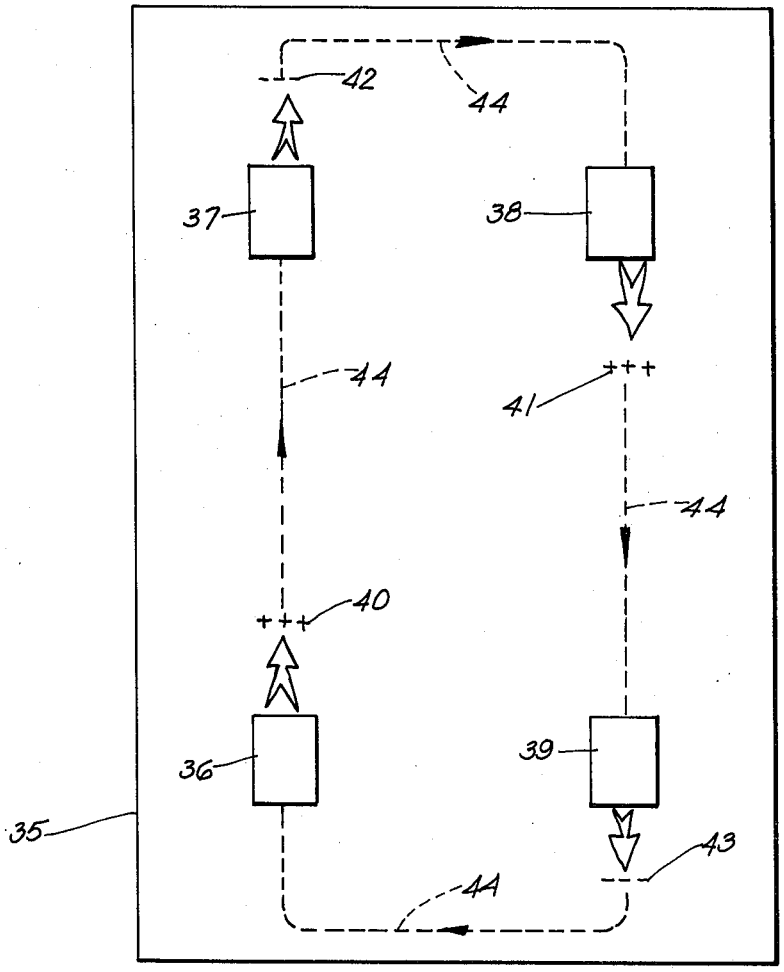
FIG. 7 is a schematic plan view of an installation utilizing a plurality of individually mounted oppositely polarized electrostatic precipitator air cleaners.

FIG. 7 illustrates a typical installation utilizing four individually mounted oppositely polarized electrostatic precipitator air cleaners. It will be understood that any number of such air cleaners may be used in such an installation, provided, however, that approximately the same number of positively and negatively polarized cleaners are employed. The individual precipitators may be mounted within the enclosed area in any suitable fashion, such as suspended from a ceiling or supported on suitable stands. Turning to FIG. 7, enclosed area 35, which may represent a manufacturing facility, such as a welding shop, contains four suitably mounted electrostatic precipitator air cleaners 36–39. As described in connection with FIG. 1, contaminated air is admitted at one end of the precipitators and relatively particle-free air is exhausted at the outlet end of the precipitators. In the particular arrangement illustrated in FIG. 7, precipitators 36 and 38 exhaust air containing positively charged particles 40 and 41, respectively, while precipitators 37 and 39 exhaust air containing negatively charged particles 42 and 43, respectively. The oppositely polarized precipitators are arranged in alternating locations throughout the room, as shown in FIG. 7. This arrangement not only insures thorough mixing of the oppositely charged particles exhausted from the precipitators, but also sets up the airflow pattern shown by dashed line 44 which significantly contributes to the flow of contaminated air into the precipitators and the overall effectiveness of the system. It will be understood by one skilled in the art that the number of electrostatic precipitators utilized, their relative placement within the working environment, and the orientation of inlet and outlet airflow directions will depend upon the particular application involved, in order to insure maximum cleaning and treating effectiveness. For example, in some installations it may prove more desirable to orient the electrostatic precipitators in facing arrangements, similar to the orientation shown in FIG. 1. In other applications it may be required to produce a particular airflow pattern, depending on the geometry, topology and degree of air contamination within the working environment.

Figure 2:
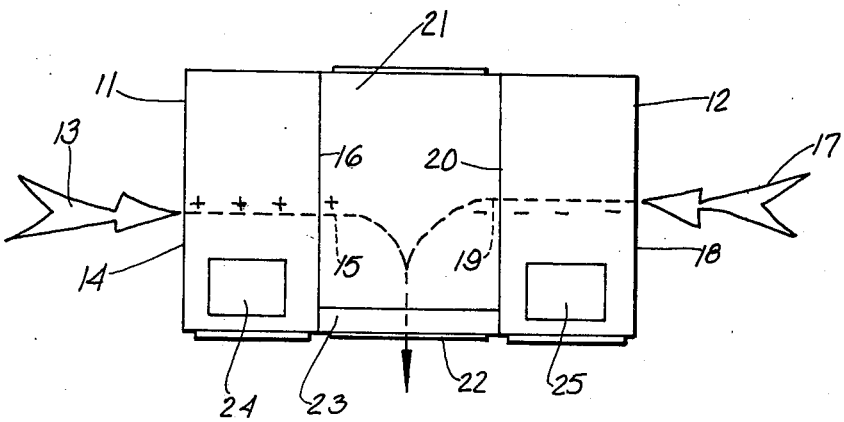
FIG. 2 is a schematic plan view of a pair of oppositely polarized electrostatic precipitator air cleaners mounted in facing relationship to combine their respective airstreams in a common mixing chamber.
Figure 3B:
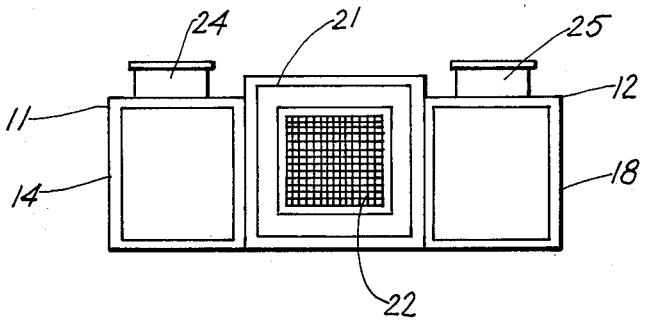
FIG. 3 is a front elevation view of the arrangement of FIG. 2.
Figure 4A:
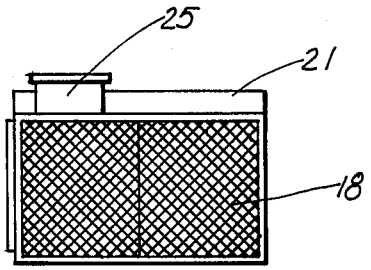
FIG. 4 is a side elevation view of the arrangement of FIG. 2.

FIG. 2–FIG. 4 illustrate another arrangement of the oppositely polarized electrostatic precipitator air cleaners of the present invention utilizing a common mixing chamber. This arrangement comprises a pair of oppositely polarized air cleaners 11 and 12, similar to those described in the embodiment of FIG. 1. Air cleaner 11 admits contaminated air 13 at inlet 14 and exhausts relatively clean air 15 containing positively charged particles at outlet 16. Similarily, air cleaner 12 admits contaminated air 17 at inlet 18 and exhausts relatively clean air 19 containing negatively charged particles at outlet 20.

Relatively clean air 15 and 19 are conducted, either directly or through suitable conduits (not shown), to mixing chamber 21 where both airstreams admix. Mixing chamber 21 comprises a box-like structure having inlets located in its sides for admitting airstreams from both air cleaners 11 and 12, and an outlet opening 22 in one end for exhausting the mixed air. The airstreams bearing charged particles from both air cleaners 11 and 12 comingle within mixing chamber 21. As stated, the mixed air is exhausted from outlet opening 22 into the working area, not shown.

In order to assist the air flow through the air cleaners and the mixing chamber, a suitable blower, shown diagrammatically at 23, may be provided to suck contaminated air 13 and 17 into the electrostatic precipitators 11 and 12, through mixing chamber 21, and exhaust the relatively clean mixed air from outlet 22. Blower 23 may be of the type, well understood in the art, to produce additional turbulence within mixing chamber 21 to aid in the comingling process.

High voltage power supply 24 for electrostatic precipitator 11 may be mounted in any convenient position, such as that shown in FIG. 2–FIG. 4 atop the air cleaner. Likewise, power supply 25 associated with air cleaner 12 may be mounted in any suitable location, such as atop air cleaner 12. It will be further understood by one skilled in the art, that the positions of air cleaners 11 and 12 may be reversed, so that electrostatic precipitator 11 produces air containing negatively charged particles while electrostatic precipitator 12 produces air containing positively charged particles. In addition, the relatively clean mixed air may be exhausted from mixing chamber 21 at the rear of the chamber, rather than at the front of the chamber as shown in FIG. 2–FIG. 3.

Figure 5:
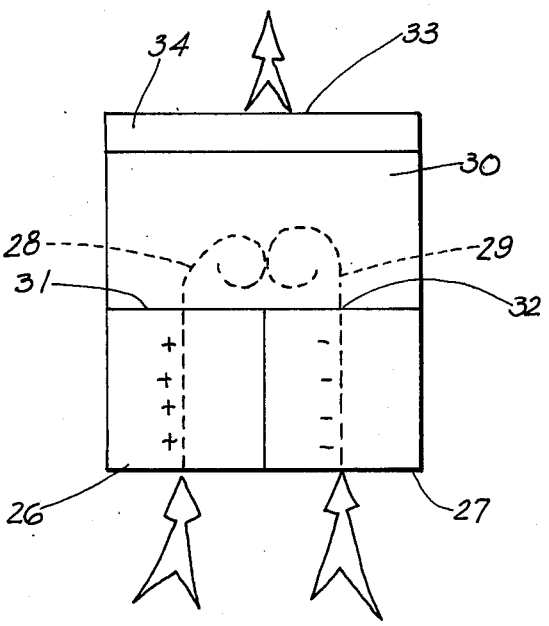
FIG. 5 is a schematic plan view of a pair of oppositely charged electrostatic precipitator air cleaners horizontally mounted in parallel exhaust relationship using a common mixing chamber.

FIG. 5 illustrates diagrammatically a plan view of another arrangement utilizing a pair of oppositely polarized electrostatic precipitator air cleaners 26 and 27 arranged horizontally with parallel exhaust airstreams 28 and 29 comingling in a common mixing chamber 30. Air cleaners 26 and 27 are similar in operation and construction to the precipitators described in connection with the embodiment of FIG. 2–FIG. 4, air cleaner 26 exhausting relatively clean air 28 containing positively charged particles, while electrostatic precipitator 27 exhausts relatively clean air 29 containing negatively charged particles. In the embodiment of FIG. 5, air cleaners 26 and 27 are mounted in side-by-side arrangement so that airstreams 28 and 29 are substantially parallel. Comingling of the airstreams occurs in mixing chamber 30 in a similar manner to that described in connection with the embodiment of FIG. 2–FIG. 4. Mixing chamber 30 is a substantially closed box-like structure having inlet means 31 and 32 adjacent the outlets of air cleaners 26 and 27 respectively, and an outlet 33 located in the wall opposite inlets 31 and 32. A blower 34 may also be provided, in a manner similar to that described hereinbefore for the embodiment of FIG. 2–FIG. 4, to assist in the flow of air through air cleaners 26 and 27 and the comingling of the oppositely charged particles within mixing chamber 30.

Figure 6:
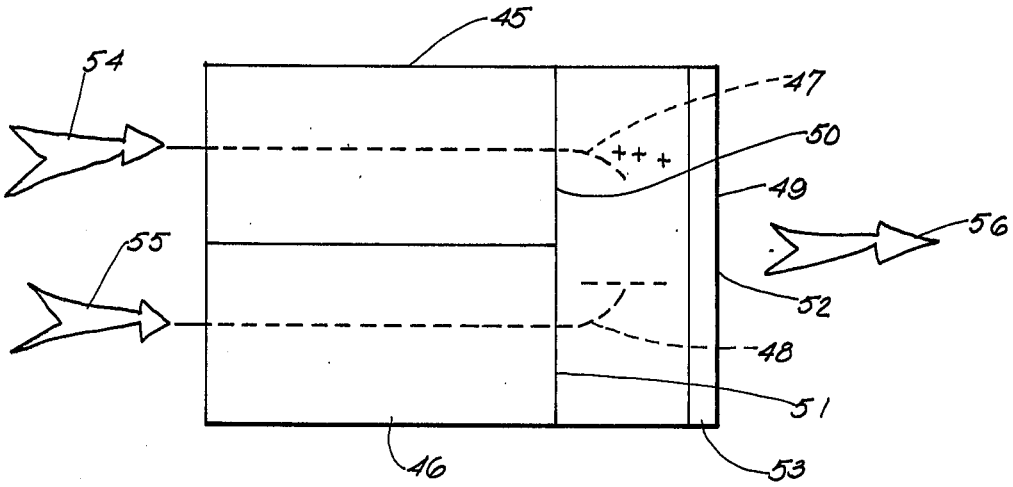
FIG. 6 is a side elevation view of a pair of oppositely charged electrostatic precipitator air cleaners vertically mounted in parallel exhaust relationship using a common mixing chamber.

FIG. 6 illustrates diagrammatically a side elevation view of another arrangement utilizing a pair of oppositely polarized electrostatic precipitator air cleaners 45 and 46 arranged vertically with parallel exhaust airstreams 47 and 48 comingling in a common mixing chamber 49, in a similar manner to the embodiment described in connection with FIG. 5. Air cleaners 45 and 46 are similar in operation and construction to the precipitators described in connection with the embodiment of FIG. 5, air cleaner 45 exhausting relatively clean air 47 containing positively charged particles, while electrostatic precipitator 46 exhausts relatively clean air 48 containing negatively charged particles. In the embodiment of FIG. 6, air cleaner 45 is mounted atop air cleaner 46 so that airstreams 47 and 48 are substantially parallel. Comingling of the airstreams occurs in mixing chamber 49 in a similar manner to that described in connection with the embodiment of FIG. 5. Mixing chamber 49 is a substantially closed box-like structure having inlet means 50 and 51 adjacent the outlets of air cleaners 45 and 46, respectively, and an outlet 52 located in the wall opposite inlets 50 and 51. A blower, shown diagrammatically at 53, may also be provided, in a manner similar to that described hereinbefore for the embodiment of FIG. 5 to assist in the flow of air through air cleaners 45 and 46 and comingling of the oppositely charged particles within the mixing chamber 49. Contaminated air admitted to the apparatus at 54 and 55 is exhausted as relatively particle-free air 56 at outlet 52 to be dispersed to the working area, not shown.

It will be understood that for each of the embodiments described hereinbefore, the apparatus may comprise several units spaced within the working area. In addition, each individual unit may comprise a plurality of oppositely polarized electrostatic precipitator air cleaners. Further, it will be understood that various changes in the details, materials, steps and arrangements of parts, which have been herein described and illustrated in order to explain the nature of the invention, may be made by those skilled in the art with the principles and scope of the invention as expressed in the appended claims.

I claim:

1. A method for preventing the deposition of airborne particles on walls and other exposed surfaces in an enclosed area containing air contaminated with particles, said method comprising the steps of:

a. in a first two stage electrostatic precipitator air cleaner, passing air contaminated with particles from the enclosed area over a positively charged ionizer to produce air containing positively charged particles, collecting some of said positively charged particles on one or more collector plates in a first collector positioned downstream from said positively charged ionizer, and exhausting from said first collector a relatively clean airstream containing some positively charged particles;

b. in a second two stage electrostatic precipitator air cleaner, passing air contaminated with particles from the enclosed area over a negatively charged ionizer to produce air containing negatively charged particles, collecting some of said negatively charged particles on one or more collector plates in a second collector positioned downstream from said negatively charged ionizer, and exhausting from said second collector a relatively clean airstream containing some negatively charged particles; and c. mixing said air streams d. exhausting said mixed airstreams from said first and second collectors into the enclosed area.

2. The method according to claim 1 including a mixing chamber for mixing said airstreams exhausted from said first and second collectors wherein said mixing step includes mixing said airstreams in said mixing chamber.

3. A method for preventing the deposition of airborne particles on walls and other exposed surfaces in an enclosed area containing air contaminated with particles, said area further containing a plurality of two stage electrostatic precipitator air cleaners, some at least of said air cleaners having an ionizer for imparting a positive electrical charge to some of said particles and a collector positioned downstream from said positive ionizer comprising at least one collecting plate for collecting said positively charged particles, some at least of said air cleaners having an ionizer for imparting a negative electrical charge to some of said particles and a collector positioned downstream from said negative ionizer comprising at least one collector plate for collecting said negatively charged particles, said method comprising the steps of:

a. Passing air contaminated with particles from the enclosed area over the positively charged ionizer of a first two stage electostatic precipitator air cleaner to produce air containing positively charged particles;
b. Collecting some of said positively charged particles on said collector plate of said collector positioned downstream from said positive ionizer of said first air cleaner;
c. Exhausting a relatively clean airstream containing some positively charged particles from said collector of said first air cleaner;
d. Passing air contaminated with particles from the enclosed area over the negatively charged ionizer of a second two electrostatic precipitator air cleaner to produce air containing negatively charged particles;
e. Collecting some of said negatively charged particles on said collector plate of said collector positioned downstream from said negative ionizer of said second air cleaner;
f. Exhausting a relatively clean airstream containing some negatively charged particles from said collector of said second air cleaner;
g. Mixing the airstream exhausted from said collector of said first air cleaner with the airstream exhausted from said collector of said second air cleaner; and
h. Exhausting said mixed airstreams into the enclosed area.

4. The method according to claim 3 including a mixing chamber for mixing said airstreams exhausted from said collectors of said air cleaners, wherein said mixing step includes mixing said airstreams in said mixing chamber.

5. Apparatus for preventing the deposition of airborne particles on walls and other exposed surfaces in an enclosed area, said apparatus comprising:
a. A first two stage electrostatic precipitator air cleaner including a duct-like enclosure having an inlet for admitting air contaminated with particles, a positive ionizer for imparting a positive electrical charge to the particles, a first collector positioned downstream from said positive ionizer comprising at least one collector plate for collecting said positively charged particles, and an outlet for exhausting from said first collector an airstream comprising relatively clean air containing some positively charged particles;
b. A second two stage electrostatic precipitator air cleaner including a duct-like enclosure having an inlet for admitting air contaminated with particles, a negative ionizer for imparting a negative electrical charge to the particles, a second collector positioned downstream from said negative ionizer comprising at least one collector plate for collecting said negatively charged particles, and an outlet for exhausting from said second collector an airstream comprising relatively clean air containing some negatively charged particles, said first and second air cleaners being positioned so that the airstream exhausted from said first air cleaner mixes with the airstream exhausted from said second air cleaner.

6. The apparatus according to claim 5 including a mixing chamber for mixing said airstreams exhausted from said air cleaners, said mixing chamber including a first inlet operatively connected to said outlet of said first air cleaner, a second inlet operatively connected to said outlet of said second air cleaner, and an outlet for exhausting said mixed airstreams into the enclosed area.

7. The apparatus according to claim 6 wherein said mixing chamber includes a blower, said blower being configured to aid in the mixing of said airstreams and to exhaust said mixed airstreams from said mixing chamber outlet.

8. Apparatus for preventing the deposition of airborne particles on walls and other exposed surfaces in an enclosed area, said apparatus comprising:
a. A first two stage electostatic precipitator air cleaner having an inlet for admitting air contaminated with particles, a positive ionizer for imparting a positive electrical charge to the particles, a first collector positioned downstream from said positive ionizer comprising at least one collector plate for collecting said positively charged particles, and an outlet for exhausting from said first collector an airstream comprising relatively clean air, said exhausted airstream from said first air cleaner containing some positively charged particles;
b. A second two stage electrostatic precipitator air cleaner spaced from said first air cleaner and having an inlet for admitting air contaminated with particles, a negative ionizer for imparting a negative electrical charge to the particles, a second collector positioned downstream from said negative ionizer comprising at least one collector plate for collecting said negatively charged particles, and an outlet exhasuting from said second collector an airstream comprising relatively clean air, said airstream exhausted from said second air cleaner containing some negatively charged particles, said outlet of said second air cleaner being arranged in facing relationship to said first air cleaner outlet; and
c. A mixing chamber interposed between said air cleaners including a first inlet connected to said outlet of said first air cleaner for admitting said airstream exhausted from said first air cleaner into said chamber, and a second inlet spaced from said first inlet and connected to said outlet of said second air cleaner for admitting said airstream exhausted from said second air cleaner into said chamber, said chamber further including a blower and an outlet, said blower being configured to produce mixing of said airstreams within said chamber and to exhaust said mixed airstreams from said mixing chamber outlet.

9. Apparatus for preventing the deposition of airborne particles on walls and other exposed surfaces in an enclosed area, said apparatus comprising:
a. A first two stage electrostatic precipitator air cleaner having an inlet for admitting air contaminated with particles, a positive ionizer for imparting a positive electrical charge to the particles, a first collector positioned downstream from said positive ionizer comprising at least one collector plate for collecting said positively charged particles, and an outlet exhausting from said first collector an airstream comprising relatively clean air, said exhausted airstream from said first air cleaner containing some positively charged particles;
b. A second two stage electrostatic precipitator air cleaner adjacent said first air cleaner and having an inlet for admitting air contaminated with particles, a negative ionizer for imparting a negative electrical charge to the particles, a second collector positioned downstream from said negative ionizer comprising at least one collector plate for collecting said negatively charged particles, and an outlet exhausting from said second collector an airstream comprising relatively clean air, said exhausted airstream from said second air cleaner containing some negatively charged particles, said outlet of said first air cleaner and said outlet of said second air cleaner being arranged to exhaust substantially parallel airstreams; and c. A mixing chamber having a first inlet connected to said outlet of said first air cleaner for admitting said airstream exhausted from said first air cleaner into said chamber and a second inlet spaced from said first inlet and connected to said outlet of said second air cleaner for admitting said airstream exhausted from said second air cleaner into said chamber, said chamber further including a blower and an outlet, said blower being adapted to produce mixing of said airstreams exhausted from said air cleaners within said chamber, and to exhaust said mixed airstreams from said mixing chamber outlet.

10. The apparatus according to claim 8 wherein said first and second air cleaners are mounted such that one of said air cleaners overlies the other of said air cleaners.

* * * * *